US006892555B2

(12) United States Patent
Kubo et al.

(10) Patent No.: US 6,892,555 B2
(45) Date of Patent: May 17, 2005

(54) KNITTING FABRIC HAVING NOVEL SET UP STRUCTURE AND METHOD OF KNITTING IT

(75) Inventors: Hajime Kubo, Wakayama (JP); Kenji Furuta, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 12 days.

(21) Appl. No.: 10/480,150

(22) PCT Filed: Jun. 10, 2002

(86) PCT No.: PCT/JP02/05755

§ 371 (c)(1),
(2), (4) Date: Jun. 25, 2004

(87) PCT Pub. No.: WO02/101133

PCT Pub. Date: Dec. 19, 2002

(65) Prior Publication Data

US 2004/0231367 A1 Nov. 25, 2004

(30) Foreign Application Priority Data

Jun. 12, 2001 (JP) ..... 2001-176492

(51) Int. Cl.[7] ..... D04B 9/46
(52) U.S. Cl. ..... 66/64
(58) Field of Search ..... 66/60 R, 64, 75.1, 66/172 R, 69

(56) References Cited

U.S. PATENT DOCUMENTS 4,548,057 A * 10/1985 Essig ..... 66/172 R
5,456,096 A * 10/1995 Mitsumoto et al. ..... 66/69
5,836,177 A * 11/1998 Okuno et al. ..... 66/64
6,070,438 A * 6/2000 Okuno et al. ..... 66/172 R
6,119,050 A * 9/2000 Okuno et al. ..... 66/64
6,609,397 B1 * 8/2003 Haltenhof ..... 66/75.1

FOREIGN PATENT DOCUMENTS

JP 3-75656 B2 12/1991
JP 3099304 B2 10/2000
JP 3164507 B2 5/2001

* cited by examiner

*Primary Examiner*—Danny Worrell
(74) *Attorney, Agent, or Firm*—Rothwell, Figg, Ernst & Manbeck, P.C.

(57) ABSTRACT

A knitted fabric having a set up portion comprising stitches on a front side and stitches on a back side formed by a knitting yarn for forming the knitted fabric extending zigzag from a stitch on the front side to a stitch on the back side and vice versa, wherein the knitted fabric has a set up structure wherein part 15*a* of the knitting yarn extending from the respective stitches on the front side to the respective stitches on the back side and part 15*b* of the knitting yarn extending continuously from the respective stitches on the back side to the respective stitches on the front side are crossed with each other, thereby providing less slackness in the set up portion than in a conventional set up portion.

4 Claims, 6 Drawing Sheets

KNITTING FABRIC HAVING NOVEL SET UP STRUCTURE AND METHOD OF KNITTING IT

CROSS REFERENCE TO RELATED APPLICATION

This application is a 35 USC § 371 National Phase Entry Application from PCT/JP02/05755, Filed Jun. 10, 2002, and designating the U.S.

TECHNICAL FIELD

The present invention relates to a knitted fabric having a novel set up structure and to a method of knitting the same by using a flat knitting machine.

BACKGROUND ART

It is a common case that a lot of widening stitches are formed at a time in a region and then a knitted fabric starts knitting with that region as a set up portion. FIG. 1 shows seamless knitwear knitted in a tubular form, showing a tights 27, a sweater 1 and a tank top 28. In the diagram, arrows indicate knitting directions of the respective knitted fabrics. The tights 27 starts knitting at ankles and ends at a waist. The sweater 1, which is knitted in a direction opposite to the normal knitwear, starts at a shoulder and ends at a hem. The tank top 28 starts knitting at a hem toward a shoulder. At a set up portion S of a crotch in the tights 27, of a shoulder 5 in the sweater 1, or of a side area 29 in the tank top 28 extending to a shoulder strap where widening stitches are overlapped with stitches of a body in an orientation orthogonal to the stitches of the body, the widening stitches are formed to increase a knitting width of the knitted fabric at a stroke. The applicant previously proposed in Japanese Patent Publication No. Hei 3-75656 a method of knitting a tubular knitwear having a rib knitting by a two-bed flat knitting machine.

Referring to FIG. 6, there is shown conventional knitting steps for a right shoulder part 5 of the sweater 1 formed as the set up portion S of the sweater. The sweater 1 is knitted to be symmetrical with respect to a center line of a neckline 3. In FIG. 6, numeric characters on the left side denote the knitting steps, and laterally-oriented arrows adjacent to the numeric characters denote yarn feeding directions. "FB" denotes a front needle bed and "BB" denotes a back needle bed. Alphabets at the bottom denote needles, capital letters A, B, C, . . . denoting needles used for knitting a front body 7 of a body knitted in a tubular form and small letters a, b, c, . . . denoting those used for knitting a back body 9. For convenience of explanation, an even fewer number of needles is illustrated.

The steps 1, 2 illustrate the knitting of the neckline 3. In the step 1, a yarn feeder 111 is racked rightwards to feed the yarn to the needles A, B of the front needle bed. In the next step 2, the yarn feeder 111 is racked leftwards to feed the yarn to the needles b, a. These knitting steps are repeatedly taken to form a neckline opening 4. In the step 3, a course knitting of the neckline of the front body 7 is performed in the same manner as in the step 1, while however the yarn 113 is fed in a zigzag from the needle C. That is to say, the yarn 113 is fed zigzag to the needle C of the front needle bed, the needle c of the back needle bed, the needle D of the front needle bed, and the needle c of the back needle bed, . . . to be hooked on those needles, so as to form a set up course 115 of the right shoulder part. The knitting steps 4, 5 illustrate the knitting of the course next to the loops formed in the step 3. In the step 4, a stitch course 116 of the front body 7 including the neckline is knitted with needles of the front needle bed. In the step 5, a stitch course 117 of the back body 9 corresponding to the stitch course 116 of the front body 7 is knitted. In a region bridging between the steps 4 and 5 depicted by a broken line, stitches of a set up portion of a left shoulder part are formed in the same manner as in the part mentioned above, though not illustrated.

In the steps 3–5, the set up portion is knitted while the stitches are reduced in size. After the set up portion S thus knitted, the knitting illustrated in the steps 6, 7 is repeatedly performed with a desired stitch size, thereby knitting the body having a tubular structure of the front body 7 and the back body 9 being joined to each other at both ends thereof. FIG. 7 shows a longitudinal sectional view of the tubular knitted fabric hanging from the needle beds of the flat knitting machine. "FB" indicates the front needle bed and "BB" indicates the back needle bed.

FIG. 8 is a development viewed from the top (as viewed from a direction indicated by an arrow P of FIG. 7), showing a loop structure of the knitted fabric knitted by the knitting of FIG. 6 when spread out with the set up portion S as a center. FIG. 9 shows part of the front body of the knitted fabric folded along the set up portion S (a development viewed from a direction indicated by an arrow F of FIG. 7). As seen from these figures, each loop in the course 115 formed by the knitting yarn 113 has two side legs 115*a*, 115*b* extending in substantially parallel with each other and a relatively long distance between front and back needles. As a result of this, the knitted fabric knitted in the manner mentioned above has a loosely drooped appearance at the widening stitch part of the knitted fabric. This disfigurement cannot be modified or corrected by adjusting a stitch density (or stitch size) in the set up process.

This problem does not apply only to a knitted fabric whose front and back bodies are knitted in a double overlapped relation as a tubular fabric, but also to a knitted fabric knitted in the form of a single-layer knitted fabric, irrespective of the knitting structure, such as a plain knitting and a rib knitting.

It is an object of the present invention to provide a knitted fabric having a set up portion formed to have a less loose droop than a conventional set up portion, comprising a lot of widening stitches formed at a time for a region having no stitches.

DISCLOSURE OF THE INVENTION

The present invention provides a Knitted fabric having a set up portion Knitted by a flat knitting machine, the set up portion comprising stitches on a front side in a set up course and stitches on a back side formed by a knitting yarn for forming the knitted fabric extending zigzag from a stitch on the front side to a stitch on the back side and vice versa, wherein the knitted fabric has a set up structure wherein part of the knitting yam extending from the respective stitches on the front side in the set up course to the respective stitches on the back side and part of the knitting yarn extending continuously from the respective stitches on the back side to the respective stitches on the front side are crossed with each other.

Also, the present invention provides a method of knitting a knitted fabric wherein a lot of widening stitches are formed at a time on needles on front and back needle beds, in order to cast on the knitted fabric by using a flat knitting machine comprising at least a pair of first and second needle beds which are extended laterally and confront each other in back and front, wherein the widening stitches are sequentially formed one by one from one end of a region of the knitting fabric being set up toward the other end of the region, the method comprising:

a) the step of moving a yarn feeder toward the one end of the region and forcing the knitting yarn to be hooked on, a first needle C on one needle bed to form a first widening stitch 21, b) the step of moving the knitting yarn toward the other end of the region, guiding the knitting yarn to a position beyond a needle c for forming a next widening stitch 22 thereon, c) the step of moving the yarn feeder toward the one end of the region and forcing the knitting yarn to be hooked on a first needle c on the other needle bed to form the next widening stitch 22, d) the step of moving the knitting yarn toward the other end of the region, guiding the knitting yarn to a position beyond a needle D for forming a next widening stitch 23 thereon, and e) the step of forming widening stitches in a set up region of the knitted fabric by taking the steps a–d repeatedly with respect to a sequence of needles on the front and back needle beds located within the region.

It is preferable that following the step e, the knitting yarn is fed to a needle of the one needle bed holding the widening stitch in the set up portion, to form a stitch course continuous from the widening stitch, followed by the knitting yarn being fed to a needle of the other needle bed holding the widening stitch, to form a stitch course continuous from the widening stitch.

The method for setting up the knitted fabric can preferably be used for knitting the knitted fabric of a two-layer-shaped section comprising a first knitted fabric and a second knitted fabric formed by dividing the knitted fabric from the set up portion.

According to the present invention, in the method for knitting the set up portion by using the flat knitting machine, the widening stitches are sequentially formed one by one from one end of a region of the knitting fabric being set up toward the other end of the region. First, a yarn feeder is moved toward the one end of the region, forcing the knitting yarn to be hooked on a first needle on one needle bed to form a widening stitch. Second, the knitting yarn is moved toward the other end of the region, guiding the knitting yarn to a position beyond a needle c for forming a next widening stitch thereon, without hooking the knitting yarn on the needle. Then, the yarn feeder is moved toward the one end of the region, forcing the knitting yarn to be hooked on a first needle on the other needle bed to form the next widening stitch. Since the widening stitches are formed with the yarn feed orientation varied as mentioned above, each of the stitches is presented in the form of a twisted loop crossed at a foot thereof. When this knitting is repeatedly performed advancing toward the other end of the region, a stitch course (a row of loops) comprising the stitches on the front side and the stitches on the back side is formed in the set up region. In the set up course thus formed, one part of the knitting yarn extending from the respective stitches on the front side to the respective stitches on the back side and the other part of the knitting yarn extending continuously from the respective stitches on the back side to the respective stitches on the front side are crossed with each other. This crossing of the knitting yarn contributes to definite division of the stitches. Further, by crossing the two parts of the knitting yarn with each other, the widening stitches on the front side and the widening stitches on the back side are related with a high stitch density. This can provide a solid set up portion, thus providing less slackness in the set up portion S than in the conventional set up portion.

Also, after the stitch course in the set up portion is formed in the manner as mentioned above, the knitting yarn is fed to the needles on the one needle bed to form the stitch course continuous from the widening stitch, followed by the knitting yarn being fed to a needle of the other needle bed holding the widening stitch, to form a stitch course continuous from the widening stitch. As a result of this, the stitch in the set up course is bound to the stitch course formed continuously therefrom more firmly so that the stitch can be prevented from loosening.

When the set up portion is first formed, followed by the knitting of the knitted fabric of a two-layer-shaped section comprising a first knitted fabric and a second knitted fabric formed by dividing the knitted fabric front and back from the set up portion, the widening stitches on the front side and the widening stitches on the back side are related with a high density. This can provide a stretch of the knitted fabric at least in a lengthwise direction thereof.

BEST MODE FOR CARRYING OUT THE INVENTION

Figure 1:
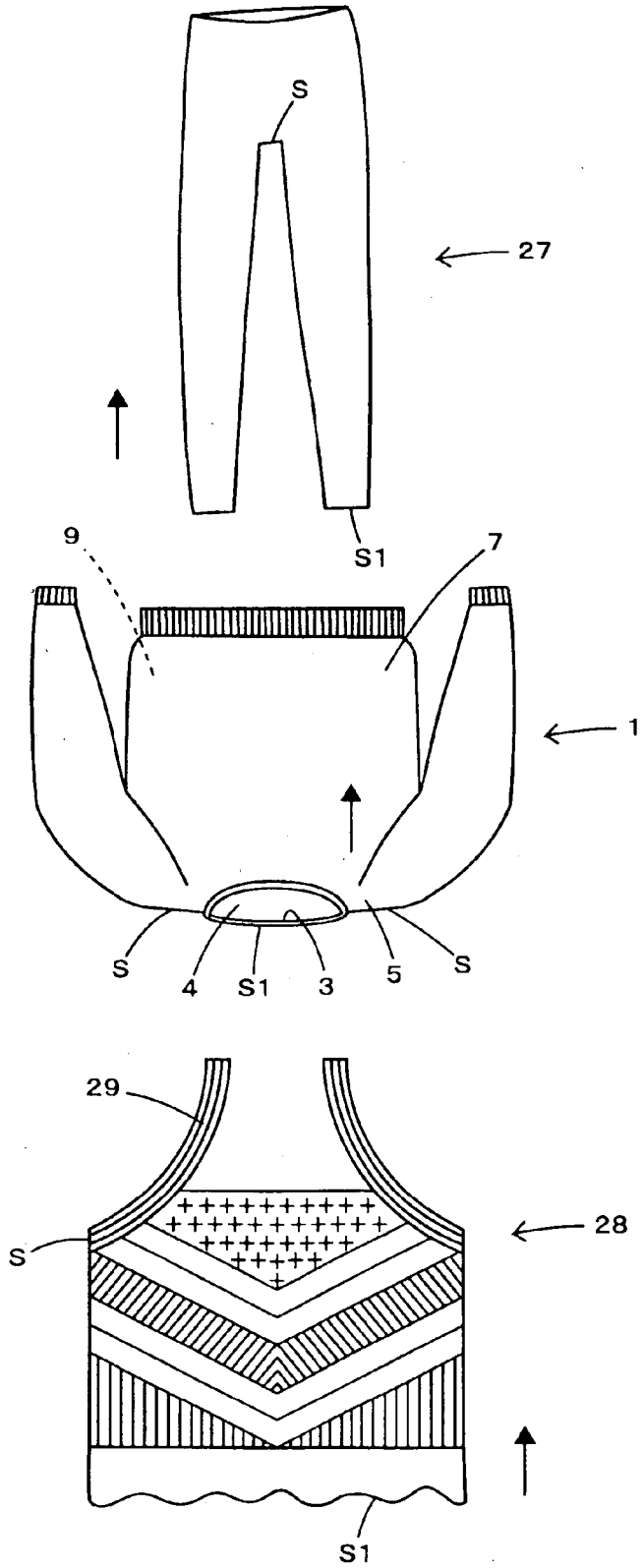
FIG. 1 shows a tights, a sweater, and a tank top which are knitwear knitted by the application of a knitting method of the present invention.
Figure 2:
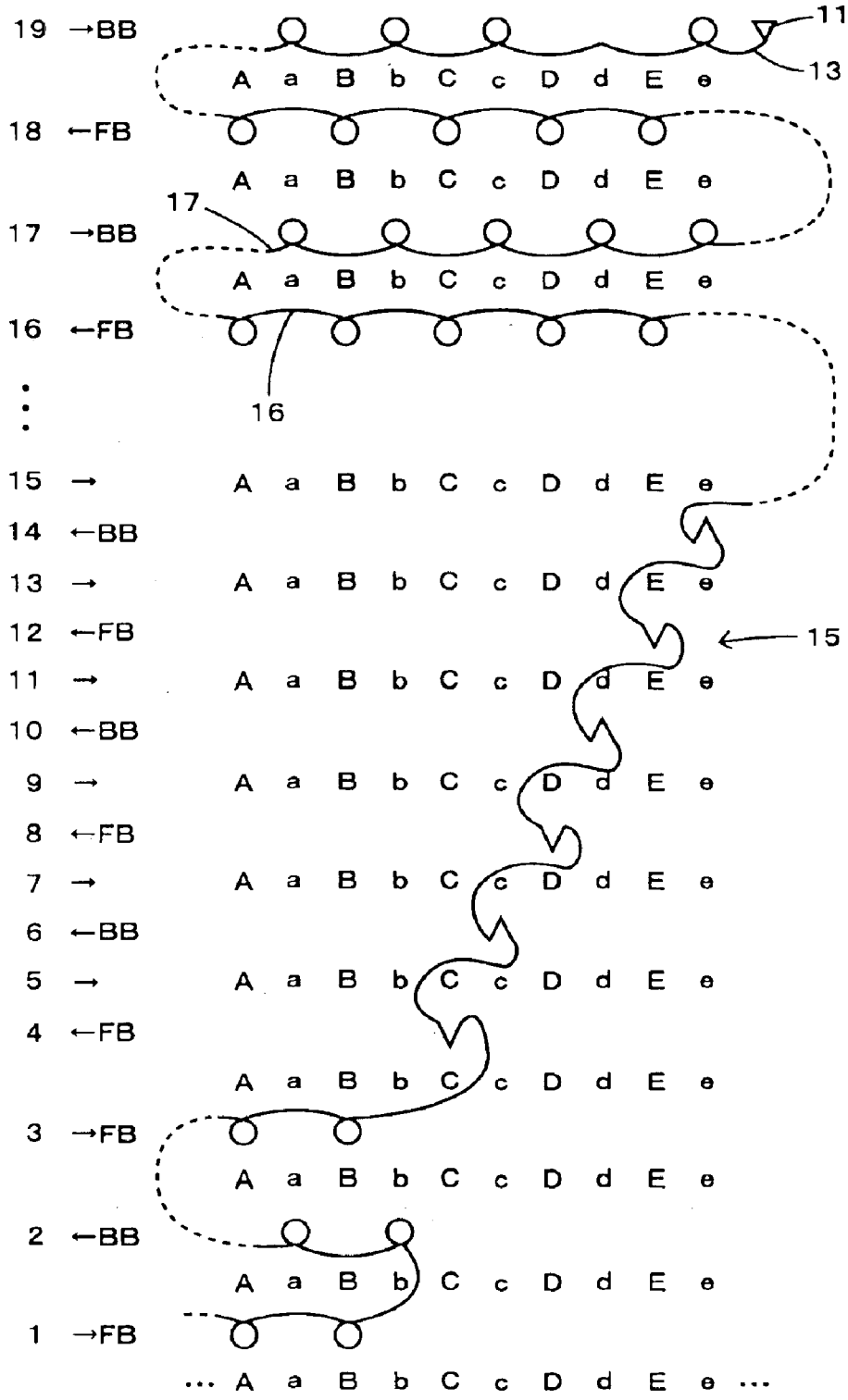
FIG. 2 is a diagram showing the knitting steps for knitting a set up portion of a right shoulder part of a sweater according to a first embodiment.
Figure 4:
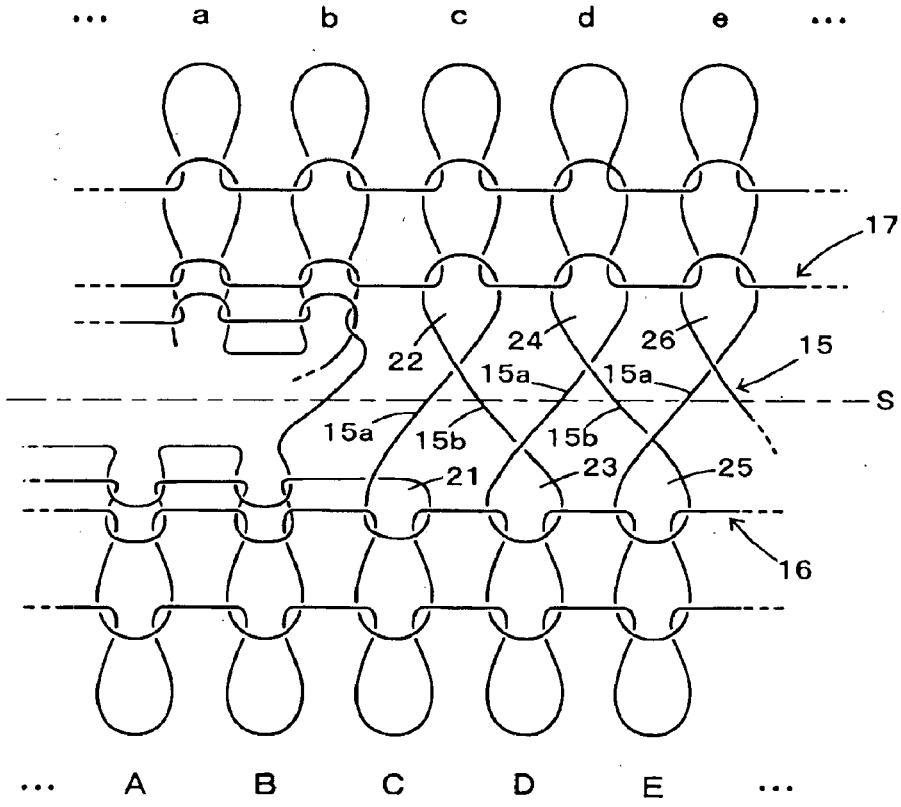
FIG. 4 is a loop structure diagram, viewed from the top, of the knitted fabric according to the first embodiment when spread out with a set up portion S as a center.
Figure 5:
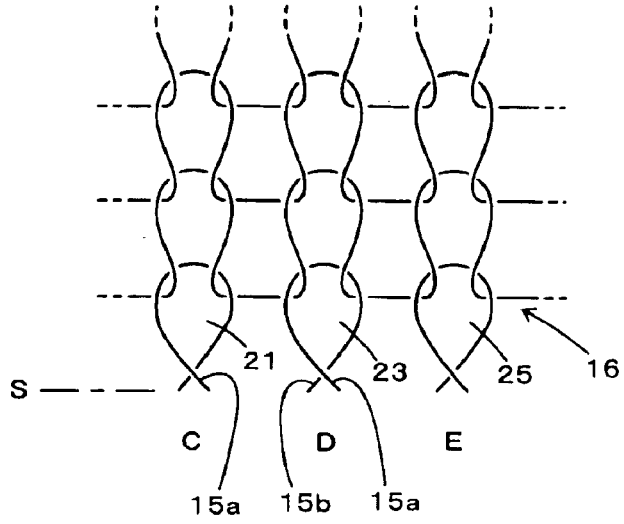
FIG. 5 shows part of a front body of the knitted fabric according to the first embodiment folded along the set up portion S.

In the following, a knitting of a set up portion S at a shoulder part of a sweater 1 shown in FIG. 1 as a preferred embodiment of the present invention will be described with reference to the accompanying drawings. FIG. 2 shows the knitting steps for knitting the widening portion; FIG. 4 is a loop structure diagram of the knitted fabric when spread out with the set up portion S as a center; and FIG. 5 shows part of a front body of the knitted fabric folded along the set up portion S. These FIGS. 2, 4 and 5 correspond to FIGS. 6, 8 and 9, respectively. In the illustrated embodiment, a so-called two-bed flat knitting machine of a general type having front and back needle beds, each having thereon a number of knitting needles arranged in line and confronting each other in front and back, the back needle bed being capable of being racked laterally so that a stitch can be transferred between the front and back needle beds, is used, though not shown.

The sweater 1, which is knitted in a direction opposite to the normal knitwear, starts from a shoulder toward a hem. The sweater 1 is knitted to be symmetrical with respect to a center line of a neckline 3. Reference is made herein to the knitting of a right shoulder part 5.

Figure 6:
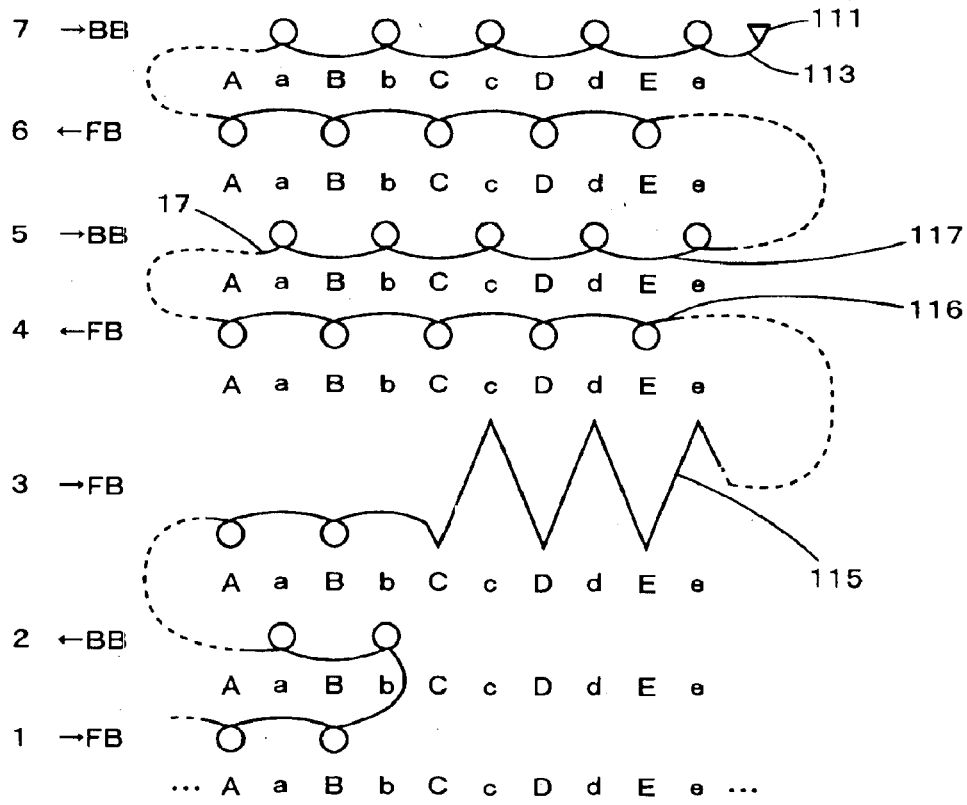
FIG. 6 shows the knitting steps for a conventional widening stitch portion.
Figure 7:
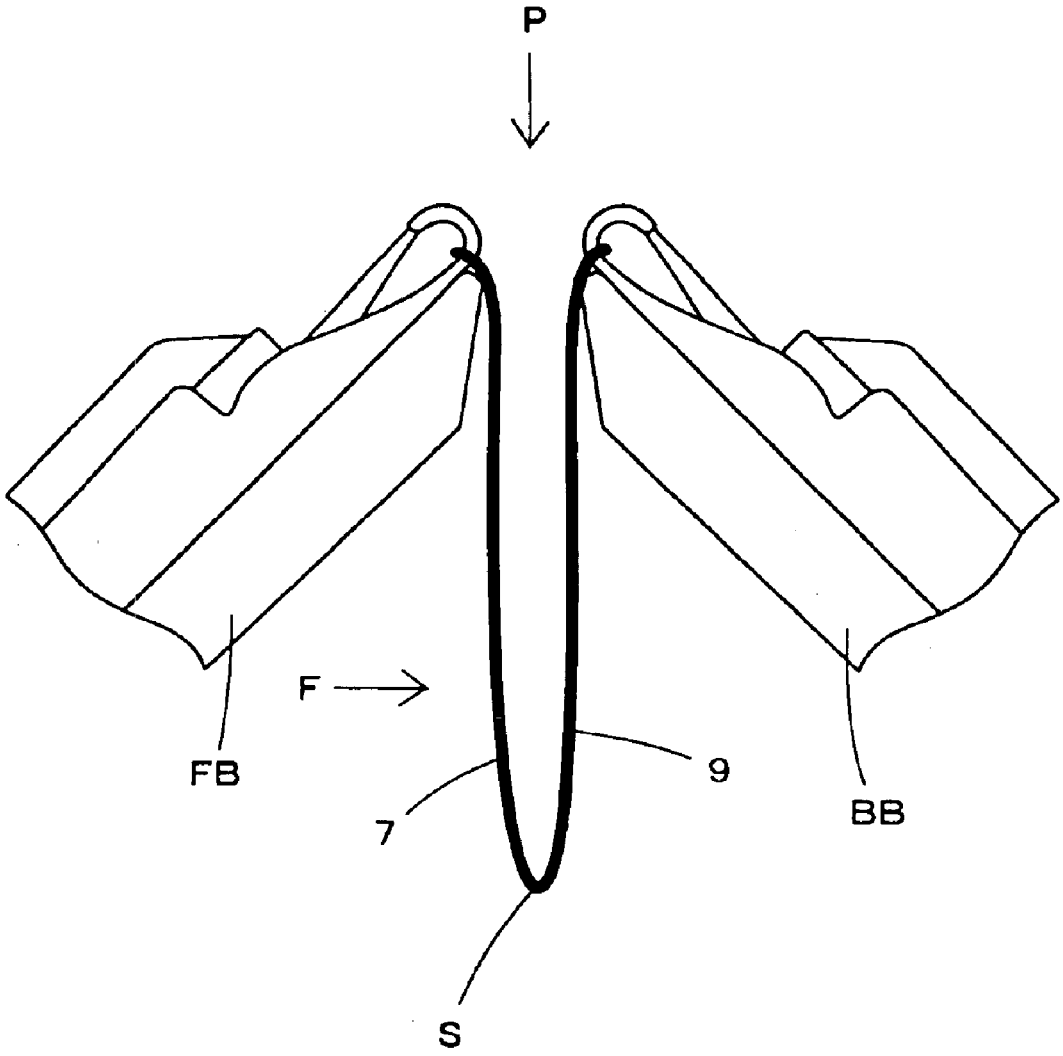
FIG. 7 shows a longitudinal sectional view of a tubular knitted fabric hanging from the needle beds of the flat knitting machine.

The steps 1, 2, which correspond to the steps 1, 2 of FIG. 6, illustrate the knitting of the neckline 3. The step 3 is the same as the step 1, illustrating the course knitting of the neckline of a front body 7. In the step 3, a yarn feeder 11 is moved at least to a position at the outside of the needle C, considering the knitting for widening stitches that starts from the next course.

The next steps 4–17 illustrate the knitting of a cast-on region of the right shoulder part 5. When the step 3 is ended, the needles C, c, D, d, . . . are at the stage of empty needles where no loops in the right shoulder part 5 are formed by the yarn 13 yet.

In the step 4, the yarn feeder 11 is moved leftwards and the yarn 13 is hooked by the needle C of the front needle bed. In the step 5, the yarn feeder 11 is merely moved to a position at the outside of the needle c, without performing the yarn feeding. In the step 6, the yarn feeder 11 is moved leftwards and the knitting yarn 13 is hooked on the needle c of the back needle bed. As illustrated in the steps 4 to 6, in a region where the knitting width is increased (in the illustrated embodiment, a region on the right side with respect to the neckline 3), the yarn is fed leftwards to form the stitches of the set up portion S. The knitting of the next steps 7 to 15 is performed in this manner. As a result, the stitches in the region where the knitting width is increased are formed in the manner illustrated in the steps 4 and 6.

Figure 3:
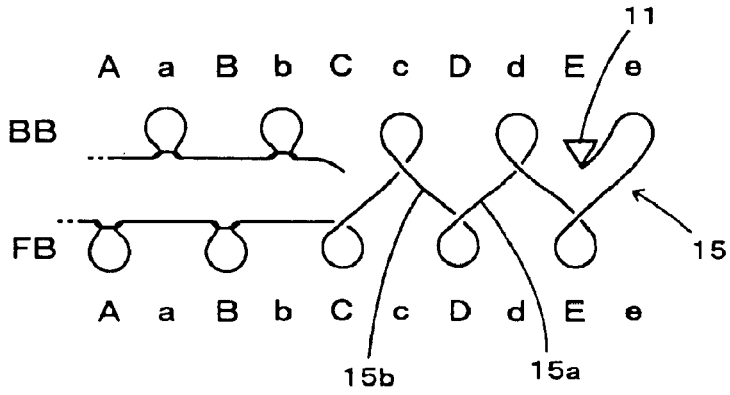
FIG. 3 shows a state of loops held on the respective needles on the needle beds at the time of completion of the step 15 of FIG. 2.

Referring to FIG. 3, there is shown a state of the loops held on the needle beds, as viewed from the top, at the time of completion of the step 14 of FIG. 2. As illustrated, the widening loops are all in the twisted state, forming a set up course 15.

The steps 16, 17 illustrate the course knitting next to the stitches thus formed. In the step 16, the stitch course 16 of the front body including the neckline is knitted with needles of the front needle bed. In the step 17, the corresponding stitch course 17 of the back body is knitted. In a region bridging between the steps 16 and 17 depicted by a broken line, stitches of the set up portion of a left shoulder part of the body are formed in the same manner as in the part mentioned above, though not illustrated. As shown in FIG. 3, the back body 9 is knitted with the needles a, b, . . . shifted one stitch rightwards with respect to the needles A, B, . . . hooking the front body 7. Accordingly, in the set up of the right shoulder part 5, the form of widening stitches starts from the needle C of the front needle bed close to the needle b at a lateral end of the back body. It is noted in this connection that in the set up of the left shoulder part, the needle close to the needle at the lateral end of the back body is a needle of the back needle bed, though not shown, so that the form of widening stitches should preferably start from that needle of the back needle bed. Subsequently, the knitting as illustrated in the steps 18, 19 is repeatedly performed to thereby produce a tubular body.

Figure 8:
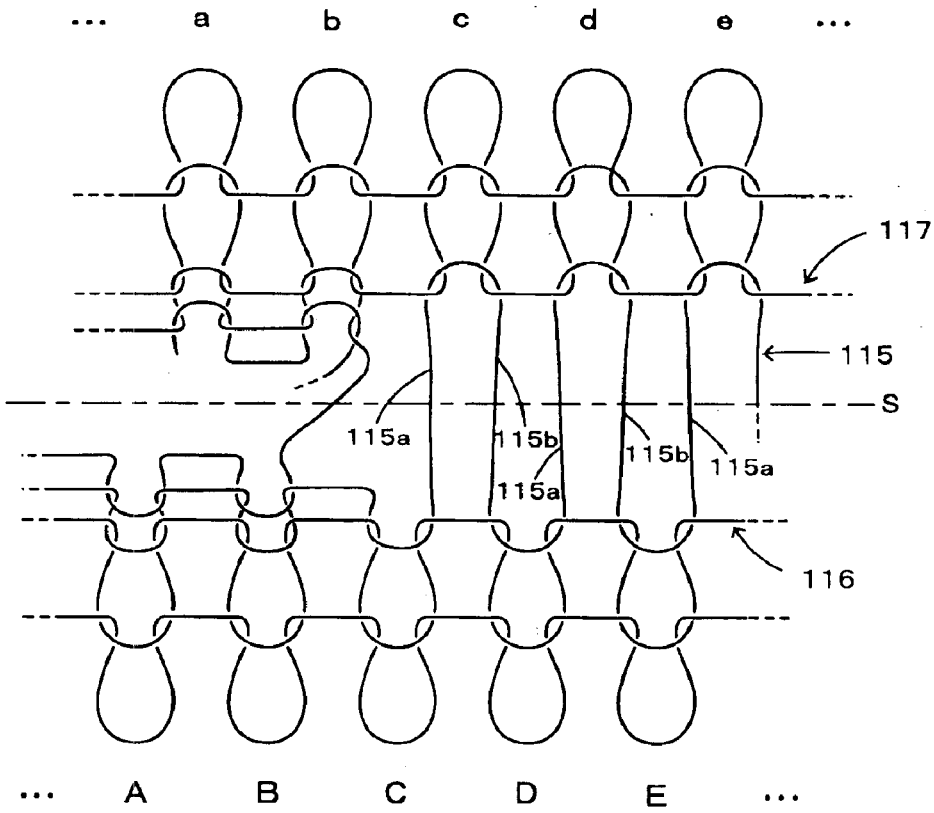
FIG. 8 is a loop structure diagram, viewed from the top, of the knitted fabric knitted by a conventional knitting method when spread out with the set up portion S as a center.
Figure 9:
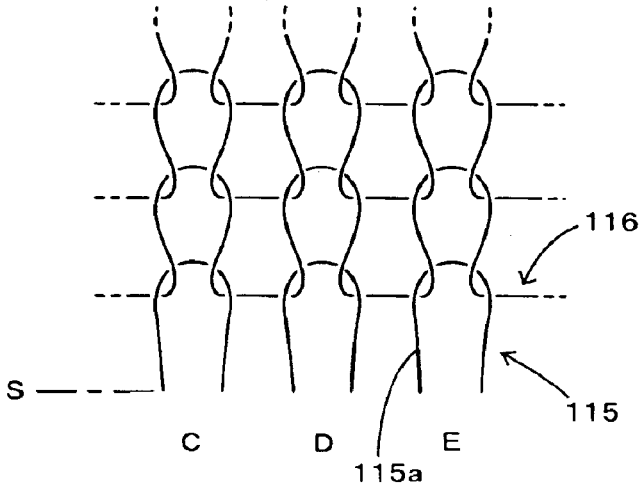
FIG. 9 shows part of the front body of the knitted fabric knitted by the conventional knitting method folded along the set up portion S.

Referring now to FIG. 4, there is shown a loop structure diagram, viewed from the top, of the knitted fabric knitted in the knitting illustrated in FIG. 3 when spread out with the set up portion S as a center. FIG. 5 shows part of the front body of the knitted fabric folded along the set up portion S. As seen from these drawing figures, in the set up course 15, two parts 15*a*, 15*b* of the knitting yarn, i.e., one part 15*a* extending from the respective stitches on the front side to the respective stitches on the back side and the other part 15*b* extending continuously from the respective stitches on the back side to the respective stitches on the front side, are crossed with each other. This crossing of the knitting yarn contributes to definite division of the stitches. For example, in FIG. 4, six stitches 21, 22, 23, 24, 25, 26 are definitely divided by the crossing of the knitting yarn. This can provide an outstanding appearance of the set up course distinguishable from that of the conventional set up course (Cf. FIGS. 8, 9) in which two side legs of each loop formed by the knitting yarn extend straight without crossing with each other. By crossing the two parts 15*a*, 15*b* of the knitting yarn extending between the stitches on the front and back sides in the set up course 15 with each other, the widening stitches 21, 23, 25 on the front side and the widening stitches 22, 24, 26 on the back side are related with a high stitch density. This can provide less slackness in the set up portion S than in the conventional set up portion. In addition, the set up portion S thus structured can allow a stretch of the knitted fabric at least in a lengthwise direction thereof, thus providing the effect that when some tension is applied to the set up portion S, the knitted fabric can well stretch to prevent breakage of the knitting yarn 13.

It is needless to say that changes and modifications may be made without departing from the sprit and scope of the claimed invention. Although one preferred knitting method for producing the knitted fabric of the present invention characterized by the set up portion has been described above, an alternate knitting method may be used, as long as two parts of the knitting yarn in the set up course, i.e., one part extending from the respective stitches on the front side to the respective stitches on the back side and the other part extending continuously from the respective stitches on the back side to the respective stitches on the front side, are crossed with each other. Also, although the embodiment wherein a knitting width is increased at a stroke by forming the widening stitches in the middle of knitting of the knitted fabric has been illustrated above, taking a tubular fabric which is knitted from the shoulder toward the hem in a direction opposite to the normal knitwear for instance, the present invention is not limited to this illustrated embodiment. For example, the present invention is also applicable to the case where the set up knitting is performed in the manner illustrated above right from the beginning (S1 of FIG. 1) before starting the knitting of the knitted fabric. Also, although in the illustrated embodiment, the widening stitches are formed by hooking the knitting yarn on the empty needles, waste knitting may be previously performed for the set up knitting region before the set up knitting, in order to allow for facilitation of the pull down of the knitted fabric by a pulling machine placed under the needle bed. In addition, the knitting method of the present invention is not applicable only to a double-layer knitted fabric parted front and back from the set up portion as in the case of the illustration, but also to a single-layer knitted fabric such as the one which is rib-knitted after setting up.

What is claimed is:

1. A knitted fabric having a set up portion comprising stitches on a front side and stitches on a back side formed by a knitting yarn for forming the knitted fabric extending zigzag from a stitch on the front side to a stitch on the back side and vice versa, wherein the knitted fabric has a set up structure wherein part of the knitting yarn extending from the respective stitches on the front side to the respective stitches on the back side and part of the knitting yarn extending continuously from the respective stitches on the back side to the respective stitches on the front side are crossed with each other.

2. A method of knitting a knitted fabric wherein a lot of widening stitches are formed at a time on needles on front and back needle beds, in order to cast on the knitted fabric by using a flat knitting machine comprising at least a pair of first and second needle beds which are extended laterally and confront each other in back and front, wherein the widening stitches are sequentially formed one by one from one end of a region of the knitting fabric being set up toward the other end of the region, the method comprising:

a) the step of moving a yarn feeder toward the one end of the region and forcing the knitting yarn to be hooked on a first needle C on one needle bed to form a first widening stitch 21, b) the step of moving the knitting yarn toward the other end of the region, guiding the knitting yarn to a position beyond a needle c for forming a next widening stitch 22 thereon, c) the step of moving the yarn feeder toward the one end of the region and forcing the knitting yarn to be hooked on a first needle c on the other needle bed to form the next widening stitch 22, d) the step of moving the knitting yarn toward the other end of the region, guiding the knitting yarn to a position beyond a needle D for forming a next widening stitch 23 thereon, and e) the step of forming widening stitches in a set up region of the knitted fabric by taking the steps a–d repeatedly with respect to a sequence of needles on the front and back needle beds located within the region.

3. The method for setting up the knitted fabric according to claim 2, wherein following the step e, the knitting yarn is fed to a needle of the one needle bed holding the widening stitch in the set up portion, to form a stitch course continuous from the widening stitch, followed by the knitting yarn being fed to a needle of the other needle bed holding the widening stitch, to form a stitch course continuous from the widening stitch.

4. The method for setting up the knitted fabric according to claim 2 or 3, which is for knitting the knitted fabric of a two-layer-shaped section comprising a first knitted fabric and a second knitted fabric formed by dividing the knitted fabric from the set up portion.

* * * * *